United States Patent [19]

Robertson et al.

[11] 4,406,595

[45] Sep. 27, 1983

[54] FREE PISTON PUMP

[76] Inventors: William C. Robertson, P.O. Box 338, Stroud, Okla. 74079; Robert H. Robertson, 2640 Heatherwood Dr., Dallas, Tex. 75228; Ray E. Forpahl, 708 N. Walnut, Harper, Kans. 67058

[21] Appl. No.: 283,747

[22] Filed: Jul. 15, 1981

[51] Int. Cl.[3] ..... F04B 43/06

[52] U.S. Cl. ..... 417/383; 417/395; 91/313

[58] Field of Search ..... 417/383, 388, 395; 91/306, 308, 313

[56] References Cited

U.S. PATENT DOCUMENTS

| | | | |
|---|---|---|---|
| 153,296 | 7/1974 | Atkinson . | |
| 1,301,485 | 4/1919 | Mueller . | |
| 1,769,044 | 7/1930 | Stevens . | |
| 1,782,144 | 11/1928 | Jensen . | |
| 1,995,611 | 3/1935 | Hapgood | 417/395 |
| 2,169,703 | 8/1939 | Mason . | |
| 2,209,090 | 7/1940 | Pierotti et al. . | |
| 2,780,177 | 5/1957 | Hoenecke | 91/306 X |
| 3,276,381 | 10/1966 | Harklau et al. | 417/395 X |
| 3,368,458 | 2/1968 | Shinaver . | |
| 3,790,310 | 2/1974 | Whelan | 417/388 |
| 3,999,896 | 12/1976 | Sebastiani | 417/383 |

*Primary Examiner*—Leonard E. Smith
*Attorney, Agent, or Firm*—Jerry W. Mills

[57] ABSTRACT

In accordance with the present invention, a pumping unit (10) is disclosed. The pumping unit includes shell structures (20, 22) each having a diaphragm (32, 38) therein to divide the pumping chamber within the structure into first and second compartments. One-way valves permit material to travel from an inlet source to the first compartment and from the first compartment to an outlet source. Deflection of diaphrams provides the impetus to draw material to the first compartment from the inlet source and drive the material to the outlet source. The motion of the diaphrams is induced by a reciprocating piston assembly (94) within a cylinder (84). The motion acts through intermediate chambers (110, 112) filled with pumping fluid and acting on the opposite side of the diaphrams from the first compartments. This permits isolation of the piston from the material being moved to prevent contamination. Limit sensors (126, 128) may be provided to sense the limits of the piston assembly reciprocation for reversing motion of the piston assembly.

8 Claims, 7 Drawing Figures

FREE PISTON PUMP

TECHNICAL FIELD

This invention relates to the transport of goods, and in particular to the pumping of materials from one location to another.

BACKGROUND ART

Conventional pumping units are often inadequate to pump materials having a high density or high solid content. For example, during drilling operation it is common to cool and clean the drill bit with circulating drilling mud. The mud is circulated by pumps which must operate continuously despite the large content of impurities in the mud and its high density. Other applications may require the pumping of solid materials which may flow in a fluid like manner, such as concrete wheat and coal.

In the past, attempts have been made to employ a pumping unit incorporating a flexible bladder positioned within a pumping chamber. The bladder is reciprocated between the walls of the chamber by a crank shaft operating through a connecting rod. The bladder divides the pumping chamber into at least one compartment. The volume of the compartment varies as the bladder is reciprocated and may be employed to impart a driving or pumping force to material entered into the compartment. This apparatus has a number of shortcomings. The bladder is exposed to the pumping pressure on one side thereof while the opposite side is typically open to atmospheric pressure. The pumping pressure is therefore limited by the strength of the bladder. The pressure limit imposed by the present bladder material is significantly less than that necessary for use as a drilling mud pump.

Conventional pumping units which rely on close tolerances between a moving piston and cylinder wall are inadequate for these types of materials. While they may provide sufficient pressure to operate in an environment such as drilling mud circulation, the abrasiveness of the pumped materials rapidly degrades the surfaces in the unit to destroy the necessary seals.

Therefore, a need exists for a pump which will operate to pump high density fluids or fluid solids mixtures which may operate at high pumping pressures. In the particular application of pumping drilling mud, a large volume of output is also required.

SUMMARY OF THE INVENTION

In accordance with one aspect of the present invention, an apparatus is provided for pumping material from an inlet source to an outlet source. The apparatus includes structure defining a pumping chamber having a first port for passage of material to be pumped and a second port for passage of material to be pumped and a second port for entry of a pumping fluid. A flexible diaphragm is provided which is secured within the structure to divide the pumping chamber into first and second compartments, the first and second ports entering the first and second compartments, respectively. Inlet check valve structure is provided for permitting flow of material from the inlet source to the first port. Outlet check valve structure is provided for permitting flow of material from the first port to the outlet source. Finally, structure is provided for alternately pressurizing and evacuating the second compartment to flex the diaphragm and vary the volume of the first compartment to pump material from the inlet source to the outlet source.

In accordance with another aspect of the present invention, the structure alternately pressurizing and evacuating the second compartment includes cylinder structure having a first port at one end thereof for fluid communication with the second compartment. A piston structure is provided which is positioned within the cylinder structure for reciprocation. The piston structure has first and second piston head assemblies at opposite ends thereof for slidable sealing contact with the cylinder structure. The cylinder structure has a sleeve assembly for slidable sealing contact with the piston structure between the head assemblies. The head assemblies and sleeve define first and second piston chambers for alternate entry of pressurized pumping fluid therein for reciprocating the piston structure. The first piston head assembly, cylinder means and second compartment form an intermediate chamber for pumping fluid, the intermediate chamber being alternately pressurized and evacuated as the piston structure reciprocates.

In accordance with yet another aspect of the present invention, a method for pumping material from an inlet source to an outlet source is provided. The method includes the step of evacuating the second compartment formed within a structure defining a pumping chamber and on one side of a flexible diaphragm secured therein to draw material from the inlet source through a first check valve assembly into a first compartment defined by the pumping chamber on the opposite side of the diaphragm. The method further includes the step of pressurizing the second compartment to pump material in the first compartment to the outlet source through a second check valve assembly, the first check valve assembly being closed to prevent pumping of material to the inlet source.

BRIEF DESCRIPTION OF THE DRAWINGS

A more complete understanding of the invention may be had by reference to the following Detailed Description taken in conjunction with the accompanying Drawings, wherein.

DETAILED DESCRIPTION

Figure 1:
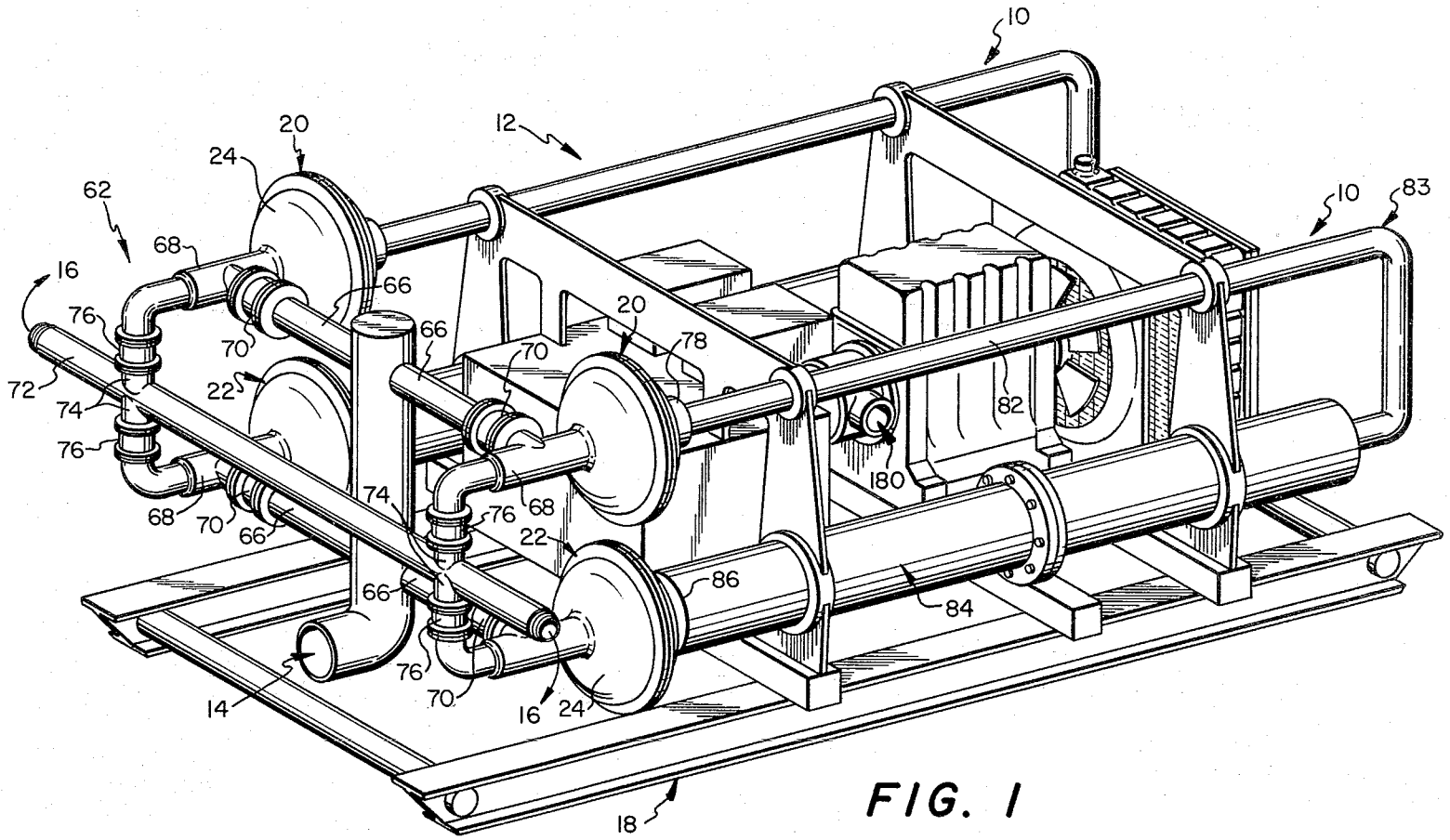
FIG. 1 is a perspective view illustrating a pumping rig combining two pumping units constructed in accordance with the present invention.

Referring now to the drawings, wherein like reference characters designate like or corresponding parts throughout several views, FIG. 1 illustrates tandem pumping units 10 mounted in a pumping rig 12. The pumping rig may be employed for pumping a material from an inlet source 14 to an outlet source 16. The inlet source may, for example, comprise a series of mud tanks for storing drilling mud for use in the drilling operation. The outlet source may, for example, communicate with the drill bit through the center core of a drill string to provide drilling mud for lifting cuttings from the well bore and cooling and cleaning the drill bit.

The pumping units 10 are substantially identical in construction. Therefore, the description of one will suffice for both. The pumping units are secured to a skid frame 18 which permits the rig to move from site to site where needed. The power source and other controls may be mounted on the frame between the units as shown. The ability to incorporate two or more pumping units for pumping material forms one significant advantage of the present invention. This advantage will be discussed in greater detail hereinafter.

Figure 2:
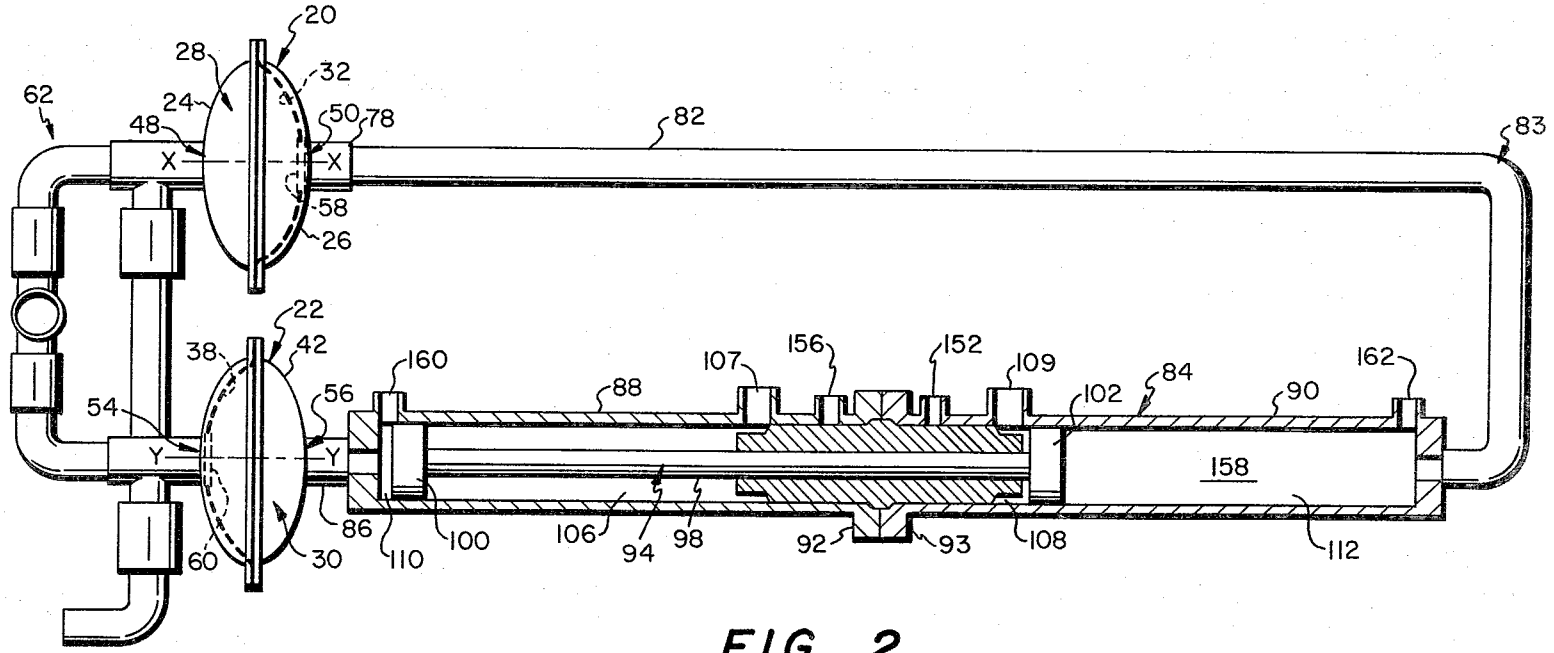
FIG. 2 is a vertical cross section view of one pumping unit.
Figure 3:
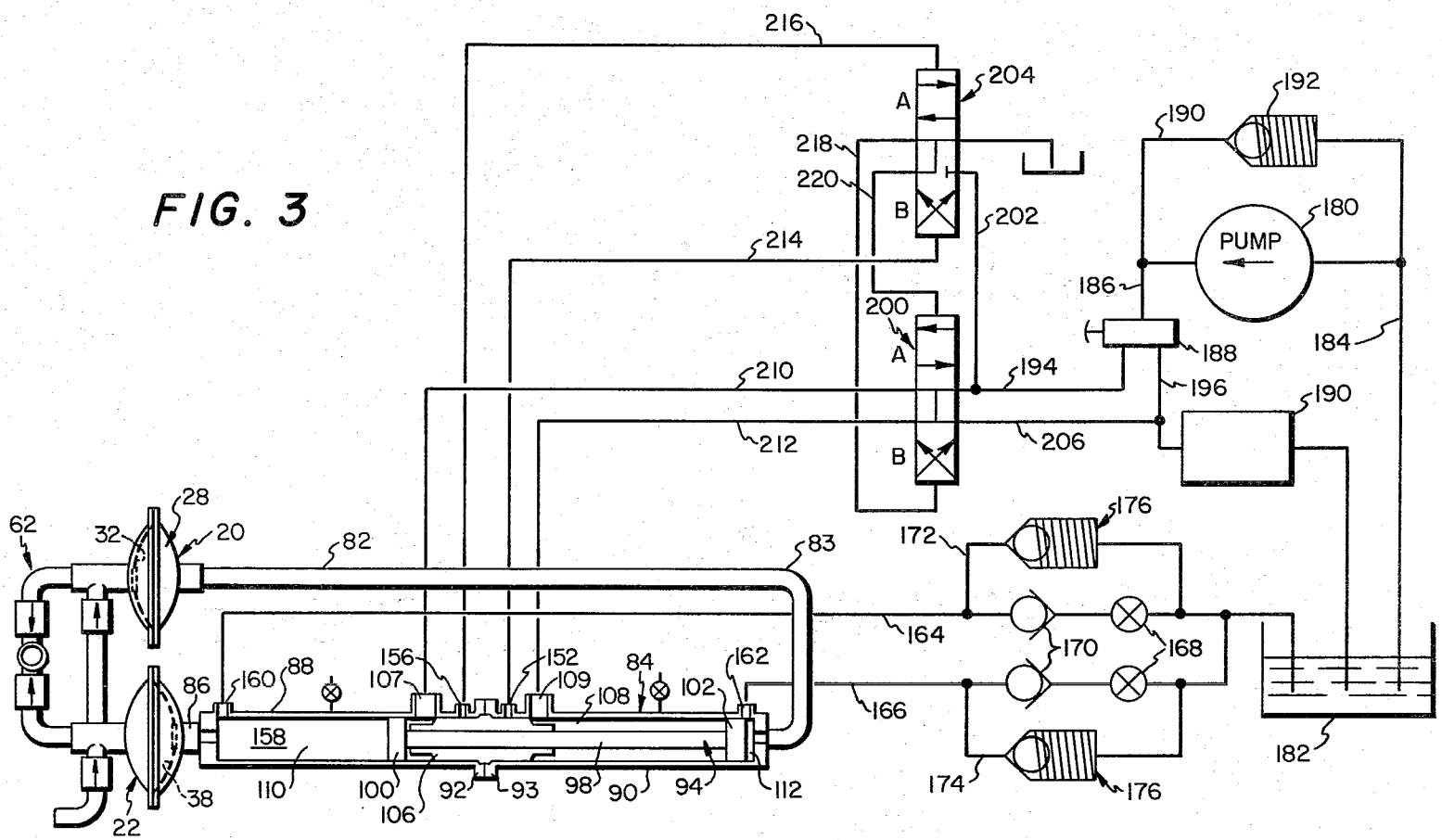
FIG. 3 is a vertical cross section view of one pumping unit in the pumping rig with a schematic of the pumping fluid flow and controls.

With reference now to FIGS. 1, 2 and 3, each pumping unit 10 includes an upper shell structure 20 and a lower shell structure 22. The structures are formed of identical half portions 24 and 26. The structure 20 defines an upper pumping chamber 28 therein. The lower structure 22 defines a lower pumping chamber 30 therein.

Figure 5:
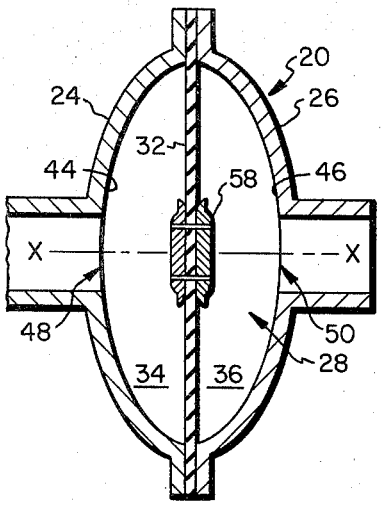
FIG. 5 is a vertical cross section view of a structure defining the pumping chamber.
Figure 6:
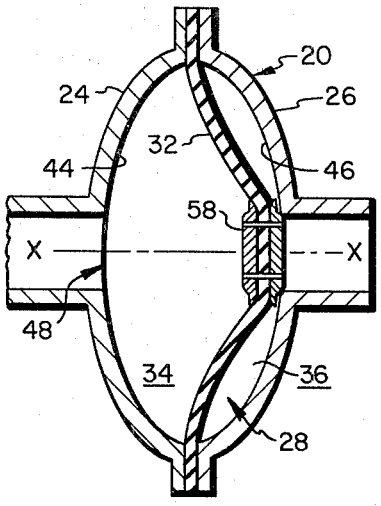
FIG. 6 is a vertical cross section view of a structure defining the pumping chamber.
Figure 7:
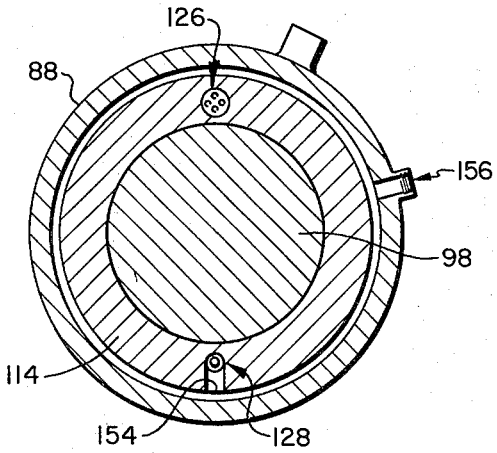
FIG. 7 is a cross section through the sleeve assembly taken along line 7—7 in FIG. 4 in the direction of the arrows.

A flexible diaphragm 32 is secured between the half portions 24 and 26 of the structure 20 as best shown in FIGS. 5 and 6. The diaphragm divides the chamber 28 into first compartment 34 and second compartment 36. A diaphragm 38 is similarly positioned in the chamber 30 which divides the chamber into first compartment 40 and second compartment 42.

The diaphragms 32 and 38 are designed to be deflected to vary the volumes of the first and second compartments by forces described hereinafter. The half portions 24 and 26 include a smooth curvilinear inner surface 44 and 46, respectively. The surfaces prevent injury to the diaphragms should they contact the surface.

A first port 48 is formed through half portion 24 in structure 20 with the port centered along the center axis X—X of the diaphragm and structure. A second port 50 is provided in half portion 26 also centered on axis X—X. The structure 22 includes a first port 54 and a second port 56 in portions 24 and 26 respectively, each centered on the axis Y—Y of the structure. The ports provide means for communication between each of the compartments and the exterior of the structures 22 and 24. The diaphragm 32 may include rings 58 on both sides of the diaphragm centered on axis X—X and secured to each other and the diaphragm by bolts or other suitable fasteners. The rings are of sufficient diameter so that a portion thereof will contact the perimeter about each port and prevent the ring from passing through a port as best shown in FIG. 6. The rings prevent the material of the diaphragm from being drawn through either the first or second ports to prevent tearing or cutting of the diaphragm material. Similar rings 60 are provided on diaphragm 38.

The first ports of each of the structures are interconnected to a manifold assembly 62 common for each unit in the rig. The assembly 62 includes a common suction line 64 extending from the inlet source. Lines 66 extend from the suction line 64 to T-connections 68 entering each port. Between each line 66 and T-connector 68 is positioned an inlet check valve assembly 70. The assembly 70 permits the material to flow through the lines 66 into the first port but prevents material flow in reverse.

A common pressure outlet line 72 is provided. Lines 74 extend from outlet line 72 to the second connection of the connectors 68. Between the lines 74 and connectors 68 are positioned on outlet check valve assembly 76 which permits flow of material from the first port to the outlet line but prevents reverse flow. The check valve assemblies 70 and 76 may be formed of any structure performing the desired function for the material pumped. For example, for solids and solid liquid mixtures, a flapper valve for sealing against a seat may be provided.

The structure 20 includes a pipe nipple 78 secured about the second port 50 as by weld 80. A connector 82 with a curved pipe assembly 83 connects the nipple 78 and extends to one end of a cylinder 84. A similar pipe nipple 86 is positioned on structure 22 as by weld 80 about the second port 56. The nipple 86 extends to the opposite end of the cylinder 84.

The cylinder 84 is comprised of two aligned cylinder sections 88 and 90. The sections are interconnected by flanges 92 and 93 at the abutting ends of the sections.

The interior surfaces of the sections 88 and 90 are formed for sliding sealed contact with a piston assembly 94 within the cylinder 84. The piston assembly 94 includes a piston shaft 98 having a uniform diameter along its length. A first piston head assembly 100 is positioned at one end of the piston shaft 98 for sliding sealed contact with the inner portion of section 88. A second piston head assembly 102 is positioned at the opposite end of piston shaft 98 for slidable sealing contact with the interior of section 90. Finally, a sleeve assembly 104 is provided with the juncture of the sections 88 and 90 for slidable sealing contact against the piston shaft 98 between the piston head assemblies.

An annular first piston chamber 106 is defined between the assembly 100 and sleeve assembly 104. A port 107 is formed in section 88 for flow of pumping fluid into chamber 106. The volume of this chamber varies with the diameter of the piston shaft 98. A similar second piston chamber 108 is defined between the piston head assembly 102 and sleeve assembly 104. A port 109 is formed in section 90 for flow of pumping fluid into chamber 108. The interior of cylinder section 88 on the side of piston head assembly 100 opposite the piston shaft 98 and the second compartment 42 combine to form a first intermediate chamber 110. The interior of cylinder section 90 on the side of piston head assembly 102 opposite the piston shaft 98, the pipe 82 and second compartment 36 combine to define the second intermediate chamber 112.

Figure 4:
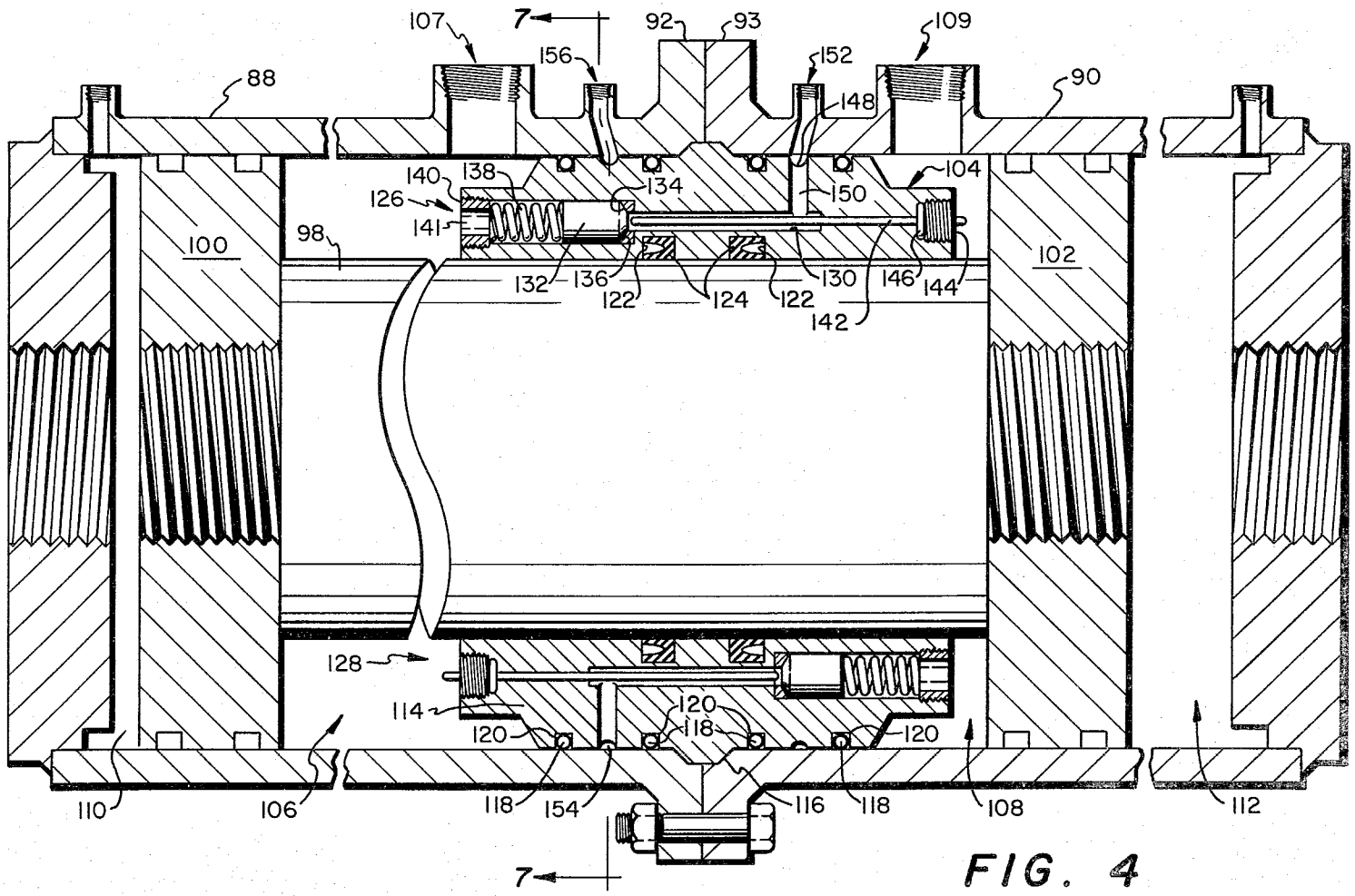
FIG. 4 is a detailed view of the cylinder sleeve assembly and piston.

The detail of the sleeve assembly 104 is best described with reference to FIG. 4. The assembly includes an annular sleeve 114 fixed within the cylinder by a rim 116 engaging insets at the ends of the cylinder sections. The sleeve is sealed to the cylinder sections by a series of circular static seals 118 seated within grooves 120. These static seals may, for example comprise O-rings of a flexible material. The inner portion of the sleeve 114 includes grooves 122 for seating dynamic seals 124. The seals 124 provide sealing contact between the sleeve 114 and outer portion of the piston shaft 98 during sliding thereof.

Two limit sensors 126 and 128 are provided to sense the abutting of the piston head assemblies 100 and 102 against the sleeve assembly 104, respectively. The limit sensors are identical and only sensor 126 will be described in detail. The sensor 126 includes a passageway 130 formed through the sleeve and communicating with each piston chamber. A poppet valve 132 is positioned within the passage which has a sealing surface 134 for engagement with a sealing surface 136 in the passage 130. The sealing surfaces are urged into engagement by a spring 138 secured in the passage 130 by a plug 140. The plug 140 has a passage 141 therethrough. The valve 132 includes a plunger pin 142 which extends through the passage 130 and exterior the sleeve. A plug 114 and seal 146 prevent flow of fluid past the pin. The passage 130 communicates with an annular groove 148 in the outer surface of the sleeve 114 between the static seals 118 through a connecting passage 150. The annular groove 148 communicates with a pilot port 152. It will be apparent that flow of fluid from the first piston chamber 106 will be blocked from the pilot port 152 by the action of the poppet valve when the second piston head assembly 102 is not abutting sleeve 114. However, when the piston head assembly 102 contacts the sleeve 114, the poppet valve 132 will be driven backward through contact between the piston head assembly and the plunger pin 142 to permit flow between the first pumping chamber and pilot port 152. The sensor 128 cooperates with a groove 154 in the sleeve 114 and a pilot port 156 communicating therewith.

The operation of the pumping unit 10 is best described with reference to FIGS. 2–4. The first and second intermediate chambers 110 and 112 are completely filled by a pumping fluid 158. A charging and relief port 160 is formed at the upper part of section 88. A charging and relief port 162 is positioned at the upper portion of section 90.

A source of pumping fluid such as reservoir 182 connected to lines 164 and 166 extending to ports 160 and 162, respectively. Positioned within each of the lines is a hand operated valve 168 and a check valve 170. To fill each of the intermediate chambers, the hand valves may be opened to permit pumping fluid into the chambers.

Reciprocation of the piston assembly as described hereinafter creates a vacuum in the intermediate chambers to draw pumping fluid into the chambers from source 182. Pressure relief bypass lines 172 and 174 may be provided in each line 164 and 166 to permit pumping fluid to leave the intermediate chamber should the fluid in the chamber exceed a predetermined pressure. The relief is provided by a relief valve assembly 176 in each bypass line preset to open at the predetermined pressure.

A pump 180 is provided. The pump draws pumping fluid from the reservoir 182 through line 184. The fluid is pressurized within the pump and leaves the pump through line 186 leading it to a manual selector valve 188. A bypass line 190 having a relief valve 192 may be provided. The relief valve is designed to open at a predetermined maximum pressure for the fluid within the system to permit flow to the reservoir.

Lines 194 and 196 form the output of the selector valve 188. The line 196 passes through an oil cooler 190 and to the reservoir 182. The line 194 extends into control valve 200. A branch line 202 from line 194 extends to a pilot valve 204. Return lines 206 and 208 extend from the control and pilot valves, respectively to the reservoir.

Pumping lines 210 and 212 extend from the control valve 200 to the ports 107 and 109, respectively. Pilot lines 214 and 216 extend from the activating ends of the pilot valve 204 to the pilot ports 152 and 156, respectively. Control lines 218 and 220 extend from the pilot valve to the activating ends of the control valve.

To initiate operation, the pump is operated and the manual selector valve 188 is activated to pass fluid into lines 194 and 202. Selector valve 188 permits the output of the pump 180 to be directed either through lines 194 or 196. If the flow is through line 194, the pumping unit 10 will operate. If the flow is through line 196 the pump output will merely be recycled to the reservoir, the pumping unit 10 will not operate and there will be no load on the pump 180. The control valve 200 will be in either position A or B during startup. If in position A, pressurized fluid will flow through line 210 into the first piston chamber 106. The pumping fluid will act against the first piston head assembly 100 to urge the piston assembly 96 to the left as shown in FIG. 2. This motion will pressurize the pumping fluid in the first intermediate chamber 110 and urge the diaphragm 38 to the left, forcing any material in the first compartment 34 outward through the outlet check valve assembly 76 and to the output line 74. The inlet check valve assembly 70 associated with the structure 22 will remain closed during this time.

Simultaneously, the second intermediate chamber 112 will be evacuated as the volume of the chamber increases. The lowering of pressure in the second compartment 36 will urge the diaphragm 32 to the right, increasing the volume of the first compartment 34. This will create a vacuum to draw material through the inlet check valve assembly 70 associated with the structure 20. During this motion, the outlet check valve assembly 76 associated with structure 20 will remain closed as the material in the line 74 is compressed or pressurized at a greater level than the first compartment.

The stroke of the piston assembly 94 will be stopped as the second piston head assembly 102 contacts and activates the limit sensor 126. This will permit pressurized fluid to flow from the first piston chamber 106 through port 152 and line 214 to the pilot valve 204. The pilot valve will be actuated to position B as shown in FIG. 2. This will permit pressurized fluid from line 202 to enter control line 218 to activate control valve 200 to position B.

With control valve 200 in position B, pressurized pumping fluid flows through line 212 into the second piston chamber 108. This acts against the second piston head assembly 102 to move the piston assembly 94 in the opposite, rightward direction as shown in FIG. 3. The first intermediate chamber will be evacuated and the second intermediate chamber pressurized by this movement. This will decrease the volume of the first compartment in the structure 20 while increasing the volume of the first compartment in structure 22. Therefore, the material in the first compartment of structure 20 will be driven to the outlet line 72 while material from the suction line 64 will be drawn into the compartment in structure 22. The first piston head assembly will contact and activate the limit sensor 128 as shown in FIG. 2 to limit the motion.

It can be readily understood that reciprocation of the piston assembly 94 within the cylinder will alternately pressurize and evacuate the first compartments of the structure 20 and 22 to pump material from the suction line to the outlet line. As noted previously, any number of pumping units 10 may be incorporated into the manifold assembly to increase the volume of material transferred.

The pumping unit 10 of the present invention may be used with virtually any material to be moved. This may include concrete, wheat, coal and drilling mud. In addition, the pumping unit may be used to pump conventional fluids such as water, or oil. The diaphragms employed in the pump are not subjected to the pressure differentials common to the prior known designs. The pressure on both sides of the diaphragm in the pumping unit 10 will be substantially identical. Therefore, the wear on the diaphragm will be only the wear incurred by the flexing as the diaphragm moves within the structures. In addition, the sealing surfaces between the piston assembly and cylinder in the pumping unit 10 are not exposed to contact with the material being transferred. Therefore, the surfaces will not be contaminated and their service life will be accordingly extended.

The displacement of the piston head assemblies in the intermediate chambers will determine the volume of material pumped. However, the volume pumped need not correspond to the volume of pumping fluid provided to the pumping chambers to achieve this displacement. The relative displacement of the intermediate and pumping chambers relates to the diameter of the piston shaft 98 within the cylinder. In one design incorporating the teachings of the present invention, a pump having an output working pressure between 2,500 and 3,000 psi was incorporated into the unit. The cylinder and piston assembly were designed to provide a 10 unit displacement output of material for an input displacement of 6 units of pumping fluid. The unit would therefore be designed to pump material up to 1,500 psi.

The pumping unit 10 permits a given volume of material to be pumped each stroke relatively independent of the pressure in the unit. The stroke of the piston, and therefore the volume pumped, is determined by the structure of the pumping unit. The pump output may be varied to vary the frequency of reciprocation and thus the output of the pumping unit. The present invention therefore provides great flexibility.

The pump 180 providing pressurized fluid to operate the pumping unit 10 may comprise one section of a multisection pump on a rig 12. Each of the sections of the pump may be used to operate one of the pumping units on the rig. The multi-section pump will be driven by any conventional engine. The engine will preferably be of the type permitting power input to the pump from a no load condition to the maximum power input for a given engine. The operator of the rig 12 has great flexibility in the operation of the rig. The operator may operate only selected pumping units 10 by controlling the manual selector valves and control the pump output to the operating pumping units with the engine powering the pump. Any desirable flow rate and pressure for the pumped material may be achieved by providing suitable pump output to drive one or more of the pumping units 10.

Although a single embodiment of the invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

We claim:

1. An apparatus for pumping material from an inlet source to an outlet source comprising:

first and second structures each defining a pumping chamber, each of said structures having a first port for passage of material into the pumping chamber and a second port for passage of pumping fluid into the pumping chamber;

first and second flexible diaphragms secured within said first and second structures, respectively and dividing each of the pumping chambers into first and second compartments, the first and second ports entering the first and second compartments, respectively;

first and second inlet check valve means for permitting flow of material only into the first compartments of said first and second structures, respectively from the inlet source;

first and second outlet check valve means for permitting flow of material only from the first compartment of each of said first and second structures, respectively, to the outlet source;

a cylinder having a first end in fluid communication with the second port of said first structure and the opposite end of said cylinder being in fluid communication with the second port of said second structure;

a piston assembly for positioning within said cylinder for reciprocation therein, the piston assembly including an elongate piston shaft and first and second piston head assemblies at each end of said piston shaft, said cylinder further having a sleeve assembly for slidable sealing contact with said piston shaft, said cylinder and piston assembly defining a first pumping chamber between the sleeve assembly and the first piston head assembly and a second pumping chamber between the sleeve assembly and second piston head assembly, a first intermediate chamber being formed by the second compartment of said first structure, said cylinder and the first piston head assembly for containing pumping fluid, a second intermediate chamber being formed by the second compartment of said second structure, said cylinder and the second piston head assembly for containing pumping fluid;

pumping means for pressurizing the pumping fluid;

toggle valve means for alternate directing of the pressurized pumping fluid between said first and second pumping chambers for alternate pressurization of said first and second pumping chambers to reciprocate said piston assembly within said cylinder, the reciprocation inducing alternate pressurization and evacuation of the first and second intermediate chambers to flex the diaphragms in said structures to pump material from the inlet source to the first compartments and to the outlet source;

pilot valve means for controlling the position of said toggle valve means; and sensor means for sensing the position of said first and second piston heads to divert a portion of the pressurized pumping fluid in the pressurized one of said first and second pumping chambers to said pilot valve means for activation thereof.

2. The apparatus of claim 1 further comprising rigid rings secured to each of said diaphragms for contacting each of said structures about the first and second ports to prevent the diaphragm from being drawn through the ports during pumping.

3. The apparatus of claim 1 wherein said sensor means comprises limit sensors positioned within said sleeve assembly of said cylinder, said limit sensors sensing motion of the piston head assemblies to predetermined limits in the reciprocation of said piston assembly to outlet pressurized fluid from the pressurized one of said first and second pumping chambers to said pilot valve means.

4. The apparatus of claim 1 wherein the dimensions of said piston shaft may be varied to vary the ratio of displacement during pumping of the pumping chambers and the displacement during pumping of the first compartments during pumping.

5. An apparatus for pumping material from an inlet source to an outlet source comprising:

first and second structures each defining a pumping chamber, each of said structures having a first port for passage of material into the pumping chamber and a second port for passage of pumping fluid into the pumping chamber;

first and second flexible diaphragms secured to said first and second structures, respectively, and dividing each of the pumping chambers into first and second compartments, the first and second ports entering the first and second compartments, respectively;

first and second inlet check valve means for permitting flow of material only from the inlet source into the first compartments of said first and second structures, respectively;

first and second outlet check valve means for permitting flow of material only from the first compartments of said first and second structures, respectively, to the outlet source;

an elongate cylinder, the second compartment of said first structure being in fluid communication with the interior of said cylinder proximate one end thereof, the second compartment of said second structure being in fluid communication with the interior of said cylinder proximate the opposite end;

a piston assembly for slidable reciprocation within the interior of said cylinder, said piston assembly including an elongate cylindrical piston shaft having a uniform outer diameter and first and second piston head assemblies at opposite ends of said piston shaft, the first and second piston head assemblies permitting sliding sealed contact between said piston assembly and the interior of said cylinder to define first and second intermediate chambers for containing pumping fluid, the first intermediate chamber including the second compartment of said first structure and the interior of said cylinder between said first end of said cylinder and the first piston head assembly, said second intermediate chamber including the second compartment of said second structure and the interior of said cylinder between said opposite end of said cylinder and the second piston head assembly;

a sleeve assembly in sealing contact with the interior of said cylinder and said piston shaft between said piston head assemblies to define first and second piston chambers between said sleeve assembly and said first and second piston head assemblies, respectively, said cylinder having first and second pumping ports for permitting flow of pumping fluid into said first and second piston chambers, respectively a hydraulic pump for pressurizing the pumping fluid;

a toggle valve for alternate directing of the pressurized pumping fluid between said first and second pumping ports to alternate pressurization and depressurization of pumping fluid within said first and second piston chambers reciprocating said piston assembly within said cylinder to alternately pressurize and evacuate said intermediate chambers, the alternate pressurization and evacuation of said intermediate chambers deflecting said diaphragms to vary the volumes of said first compartments to pump material from the inlet source to the outlet source;

a pilot valve for controlling the position of said toggle valve; and first and second limit sensors positioned in said sleeve assembly, each of said limit sensors sensing motion of one of the piston head assemblies to a predetermined limit in the reciprocation of said piston assembly and permitting pressurized pumping fluid to flow from the pumping chamber opposite said one of the piston head assemblies to said pilot valve to toggle said toggle valve.

6. The apparatus of claim 5 wherein each of said diaphrams has a rigid ring secured on both sides thereof for contacting the perimeter of said structure about the first and second ports to prevent a portion of said diaphram from passing therethrough.

7. The apparatus of claim 5 further comprising pressure relief means communicating with said first and second intermediate chambers for relieving the pressure therein at a predetermined pressure level.

8. The apparatus of claim 5 wherein the outer diameter of said piston shaft may be varied to vary the ratio of displacement of the pumping and intermediate chambers during reciprocation.

* * * * *

UNITED STATES PATENT AND TRADEMARK OFFICE

CERTIFICATE OF CORRECTION

PATENT NO. : 4,406,595

DATED : September 27, 1983

INVENTOR(S) : William C. Robertson, Robert H. Robertson and Ray E. Forpahl

It is certified that error appears in the above-identified patent and that said Letters Patent is hereby corrected as shown below:

Column 1, line 45, "solids" should be --solid--;

line 56, delete the entire line, i.e. "second port for passage of material to be pumped and a".

Column 4, line 2, "on outlet" should be --an outlet--.

Column 5, line 6, "plug 114" should be --plug 144--.

Signed and Sealed this

Tenth Day of July 1984

[SEAL]

Attest:

GERALD J. MOSSINGHOFF

Attesting Officer

Commissioner of Patents and Trademarks